United States Patent [19]

Bukowski

[11] Patent Number: 4,864,787

[45] Date of Patent: Sep. 12, 1989

[54] INTER-LOCKING CORNER STRUCTURE FOR SIDING

[76] Inventor: Stanley Bukowski, 3522 N. Newcastle, Chicago, Ill. 60634

[21] Appl. No.: 321,089

[22] Filed: Mar. 9, 1989

[51] Int. Cl.[4] ..... E04D 1/00; E04B 2/08

[52] U.S. Cl. ..... 52/284; 52/278; 52/519; 52/531; 52/545; 52/547

[58] Field of Search ..... 52/276, 521, 529, 530, 52/531, 519, 545, 539, 284, 278, 520, 57

[56] References Cited

U.S. PATENT DOCUMENTS

| | | | |
|---|---|---|---|
| 380,109 | 3/1888 | Harry | 52/519 |
| 405,379 | 6/1889 | Smith | 52/531 |
| 996,750 | 7/1911 | Dolph | 52/531 |
| 1,178,288 | 4/1916 | Ashley | 52/278 |
| 1,664,463 | 4/1928 | Muryn | 52/278 |
| 1,925,417 | 9/1933 | Swank | 52/284 |
| 2,126,676 | 8/1938 | Thomas | 52/545 X |
| 2,308,766 | 1/1943 | Martinus | 52/545 X |
| 2,427,762 | 9/1947 | Carr | 52/547 |
| 3,373,533 | 3/1968 | Trelfa | 52/284 |
| 4,271,652 | 6/1981 | Svensson | 52/520 |

*Primary Examiner*—John E. Murtagh

*Attorney, Agent, or Firm*—John J. Kowalik, Myers & Ehrlich, Ltd.

[57] ABSTRACT

A lap board type of corner structure which comprises a series of panels on opposite sides of a corner wherein one set of panels on one side of the corner have end corner-overlapping hook-shaped portions interlocking with similarly shaped end portions on the other set of panels on the other side of the corner.

10 Claims, 4 Drawing Sheets

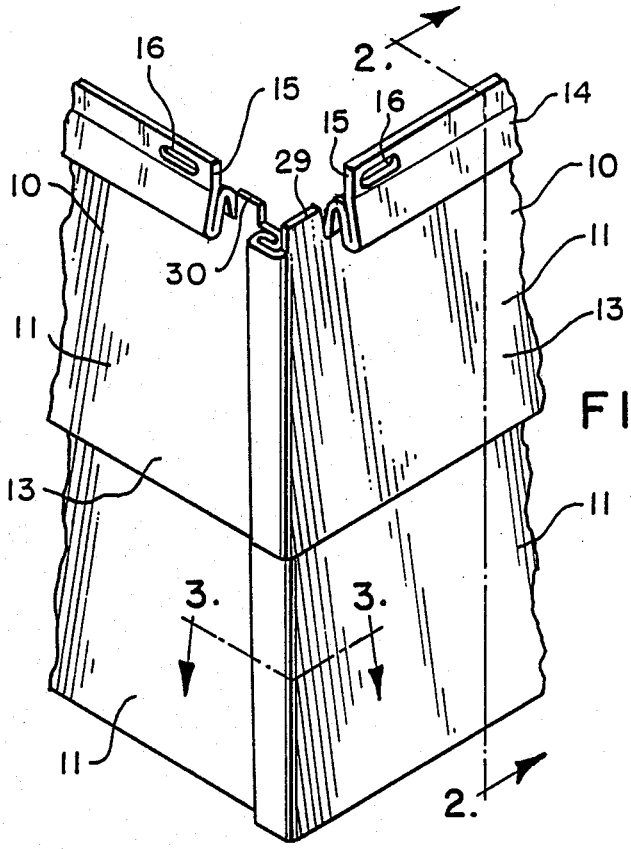
FIG. 1
FIG. 2
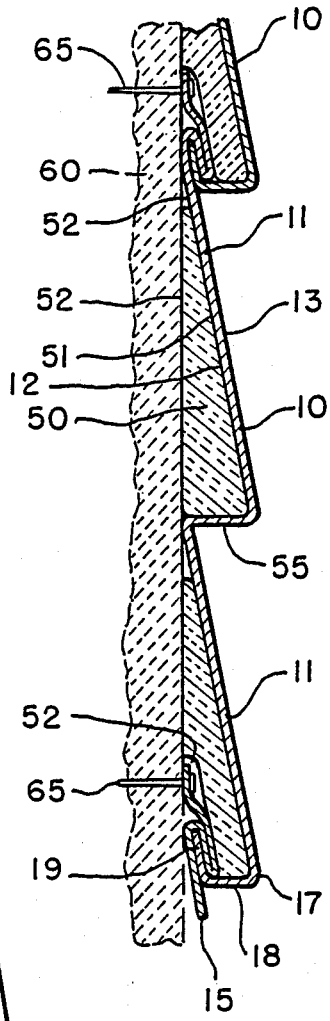
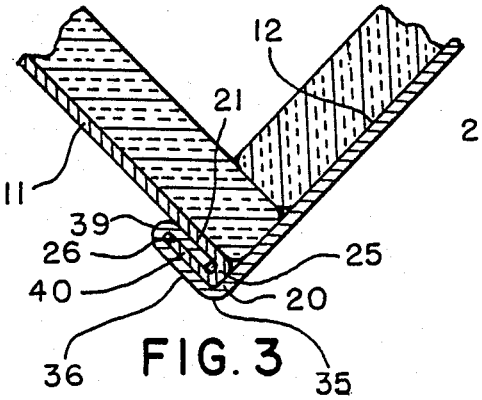
FIG. 3
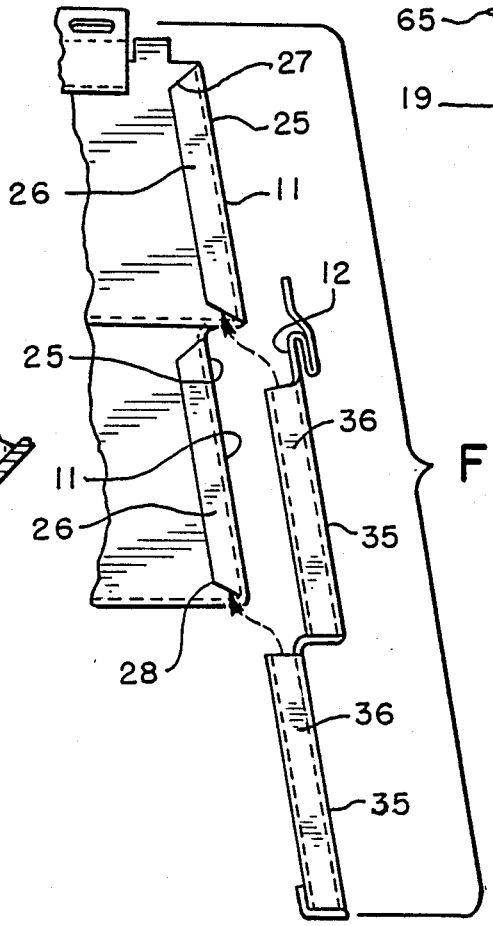
FIG. 4

FIG. 8
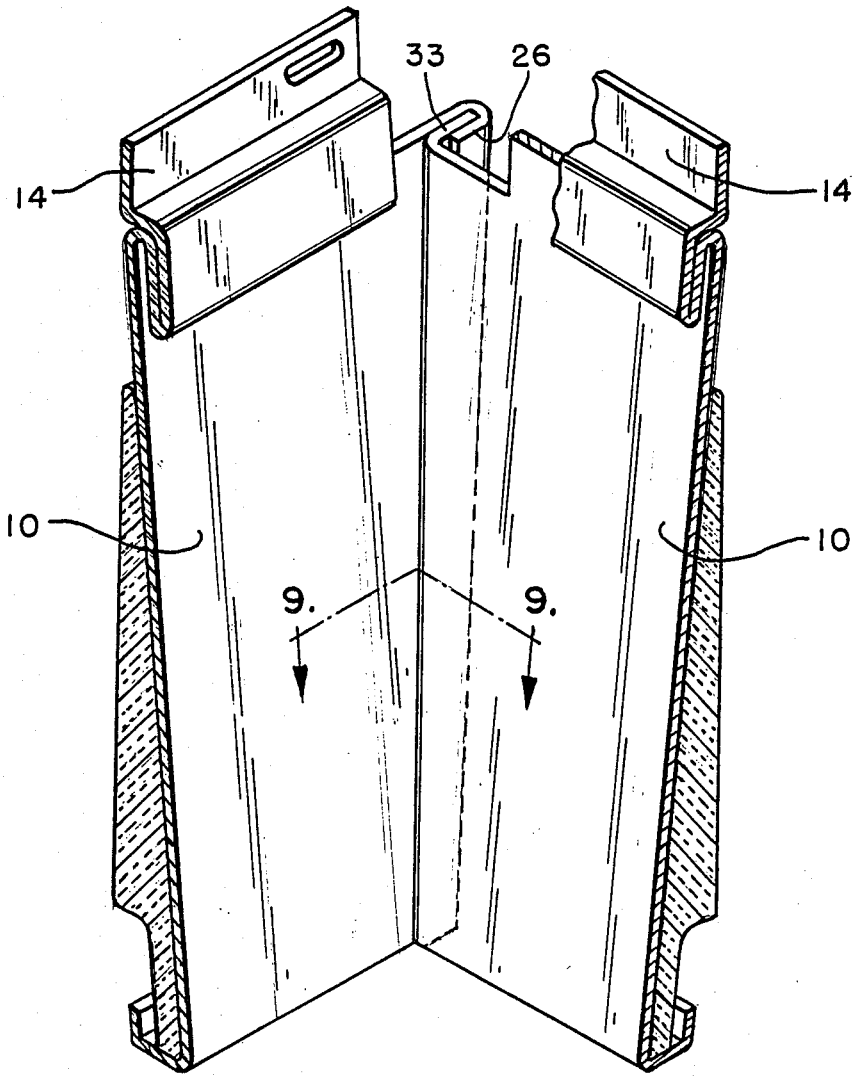
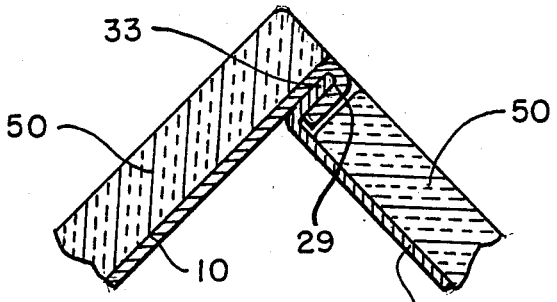
FIG. 9

INTER-LOCKING CORNER STRUCTURE FOR SIDING

BACKGROUND OF THE INVENTION

1. Field of the Invention

This invention relates to a corner structure for joining siding elements of the type applied to residences and other buildings having a series of separate laterally extending elements, or boards, having interlocking edges on both horizontal and vertical edges forming structurally sound and weather-tight overlapped seams.

2. Description of the Prior Art

The prior art primarily concerns the hanging of siding or other weatherproof surfaces on buildings, addressing arrangements for hanging or otherwise attaching individual elements in a vertical plane with only incidental reference to attachments between individual wall elements or boards at their intersection at corners of walls.

Martinus, U.S. Pat. No. 2,308,766 addresses nailing horizontally arranged elements to horizontal stringers on beams and folding the element upward on site and nailing the top of the element to the vertical beams. A second stringer is placed thereon and a second layer nailed, folded, and so forth.

Carr, U.S. Pat. No. 2,427,762 uses formed metal panels or boards having top and bottom horizontal flanges. The bottom flange extends vertically upward from an inwardly extending portion. The top flange is bent through approximately one-hundred eighty degrees forming a member of U-shaped section. The bottom flange of one panel engages the top flange of a lower panel. The lowest panel engages a separate hanger element that has a U-shaped portion similar to that of the top flange.

Thomas, U.S. Pat. No. 2,126,676 uses a structure with a stepped and U-shaped top flange engages a hanger bracket with a corresponding U-shaped flange, and a siding panel. Respective siding panels are built up one above the other, with a series of hangers and interlocking respective top and lower flanges.

Svensson, U.S. Pat. No. 4,271,652 shows building facing elements having V-cross section tongues enabling placement of the sheeting, forming a planar surface from interlocked elements rather than the overlapping stepped or shingle-like surface presented by other siding art.

The prevailing arrangement for affixation of siding, particularly to residences uses a method for cosmetically and weather sealing corners, with corner elements separate from the siding itself. Two basic variations may be found. One uses vertical L-shaped section pieces extending substantially the entire height, analogous to molding used on wooden sided houses for many years. The second method uses angled-corner pieces inwardly sloped at their tops to correspond with each pair of siding panels meeting at a corner, this forms a saw-tooth profile.

SUMMARY OF THE INVENTION

A corner structure for joining siding panels having horizontal and side edges has a series of interlocking flanges for mating the complementary siding panels. The top edge of each panel has an inverted U-shaped flange which engages with an upstanding flange of a complimentary panel. One side edge has a U-shaped flange. The side edge of the interlocking panel has a track substantially parallel to the panel surface, an overlapping flange and an additional U-shaped section forming a second underlapping flange interior thereof. Multiple side flanges and tracks permit individual panels to have multiple planes.

One advantage of this invention is that the side track and flange arrangement dispenses with the need for additional corner covering elements.

Another advantage of the invention is that the track flange arrangement provides both a structurally strong and weather-tight joint.

Another advantage of the invention is that panels may be prefabricated in predetermined lengths greatly improving the economy in production and speed of erection where standardized buildings are being constructed or refinished.

Another advantage of the invention is that it is adaptable to the use of prefabricating panel segments comprising, alternatively, flanged and straight side edges, tracked and straight side edges or two straight side edges permitting prefabrication and shipment of appropriate standardize lengths which may be used to form a panel of needed length in the field through the joining of two or more segments.

Another advantage of the invention is that the flange side edge may be readily fabricated in the field using simple skills and tools to permit ready customization of panels of a required length.

Other advantages of the invention will become apparent upon further reading of the specification.

BRIEF DESCRIPTION OF THE DRAWINGS

FIG. 1 is a perspective view of the corner structure with a multiple track, multiple plane embodiment;

FIG. 2 is a sectional view of one multiple plane siding panel and portions of a panel above and below it taken substantially on line 2—2 of FIG. 1;

FIG. 3 is a sectional view of the corner structure taken substantially on line 3—3 of FIG. 1;

FIG. 4 is an exploded edge elevational view showing a lower panel which may be raised into place interlocking an upper perpendicular panel;

FIG. 8 is a perspective view of an interior corner structure;

FIG. 9 is a sectional view of an interior corner structure taken substantially on line 9—9 of FIG. 8;

DETAILED DESCRIPTION OF THE PREFERRED EMBODIMENT

Figure 5:
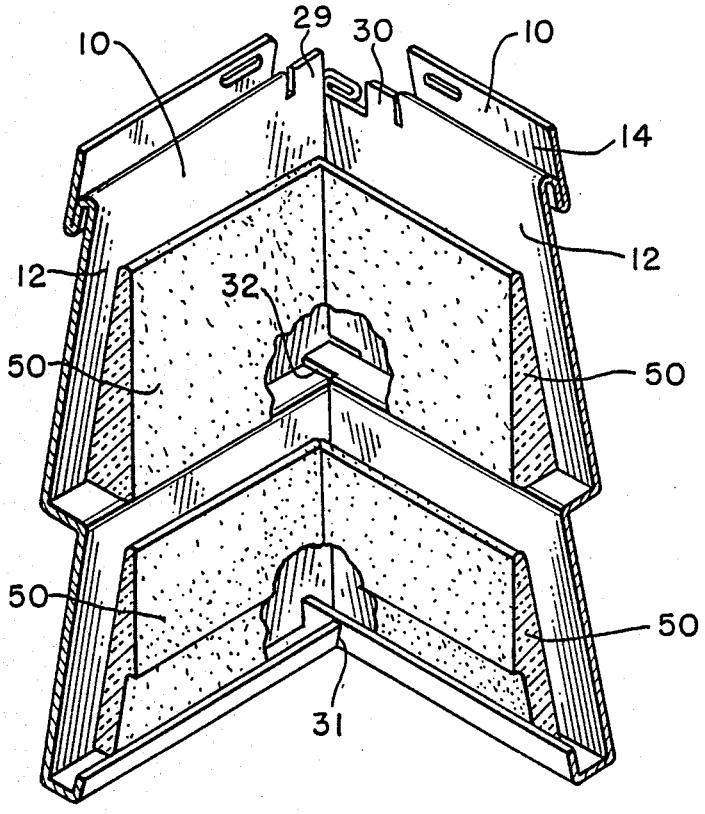
FIG. 5 is an interior perspective view of a multiple plane corner structure.

In FIG. 1, a siding panel (10) has main plates (11) providing enhanced appearance and weather protection for a building (60) as shown in FIG. 2. The panel (10) has an exterior surface (13) which may be finished to provide the desired appearance in a variety of colors, patterns or the like.

The panel (10) has a top edge (14) relieved to provide openings (16) for mounting fasteners (65) as shown in FIG. 2 to retain the panel in a fixed relationship to the appropriate building framework structural sheathing of the building (60). This embodiment utilizes a double panel in which the track is centrally displaced at a medial step (55). In this version a pair of tracks engage a corresponding pair of flanges with the resulting appearance of two lines of siding utilizing the materials of a single panel.

FIG. 1 shows a top flange (15) is formed through the longitudinal crimping of the top edge (14) into an inverted U-shaped element and then crimping it back over itself and extending vertically to form the top edge (14) for fastening as previously described.

The top corners of each of the respective interlocked panels at the corner structure are notched with the track corner (29) and flange side top corner (30) are both relieved to provide clearance for the inter-engaging vertically overlapped pair of panels, shown in section in FIG. 2.

As shown in FIG. 2 the bottom edge (17) is formed to provide a step (18) to space the plane (11) away from the building wall at the bottom thereby imparting a topwardly inward slant to the plane (11) enhancing weather tightness and appearance. In section, the angle of the step (18) with respect to the plane (11) is less than ninety degrees. The inward edge of the step (18) is upwardly extended to form a flange (19) extending substantially vertically upward therefrom.

Siding panels (10) are fastened to the building from the bottom upward by inter-engagement of the respective top and bottom flanges with overlapping corresponding panels. The lowest panel bottom flange (19) engages a bottom strip having an inverted U-shaped flange analogous to the previously mentioned top flange (15).

As shown in FIG. 3 each corner structure has two panels each of which has a (20,21). One panel has a side edge with a flange (26) formed therein by bending the extended plane (11) along the line (25). These structures are also shown in FIG. 4 where the top edge (27) and bottom edge (28) of the flange extend no further than the top and bottom of the plane (11).

As shown in FIG. 3, the other panel's side edge is formed into a track (34) which slidingly engages the flange of a corresponding panel when installed. The track is formed from an extension of the plane (11) which has a bend (35) The first bend (35) results in an overlap segment (36) substantially perpendicular in section to the plane (11) additional angles may be formed for special purposes such as non-perpendicular siding applications such as corners of an octagon, a windows or the like. In this application all relative angles will need to be changed to adapt the corresponding panels accordingly. The sheet metal is further bend back over itself into a U-shaped form at the track end bend (39) to form an underlap segment (40).

FIG. 4 shows installation of corresponding track of a panel slidingly engaging the bottom of the flange (26). The track (34) slides with the flange captured between the overlap (36) and underlap (40) mentioned in FIG. 3 and slides upwardly and inwardly corresponding to the angle of the flange as indicated by the line of the bend (25).

Returning to FIG. 3, it may be seen that on full engagement of the panels the proximity of the interior (12) of the plane (11) and opposed edge of the underlap (40) further captures the bend (25) of the flange (26) resulting in a structurally rigid corner with substantially improved weather-tight qualities by virtue of the labyrinth path from the exterior (13) of one panel to the interior (12) of the panels.

As shown in FIG. 2, it may be desirable to provide the panel (10) with insulating material (50) to improve the function as installed. In this instance the insulation material may be applied to the interior surface (12) of a thickness corresponding to the incline of the plane (11) with a substantially vertical interior insulation surface (51). The insulation may be relieved (52) to provide for engagement of the respective top (15) and bottom (19) flanges and extended in a manner to permit clearance for the sliding engagement of the flange (26) in the track (34). Insulation (50) can be adapted to conform with the medial step of FIGS. 1–5 or the single plane configuration of FIGS. 6–9.

FIG. 5 shows the interior of the corner structure of the two plane panel arrangement. Apparent in this view of the panels (10) are the interior surfaces (12) with insulation (50) affixed thereto. The insulation (50) is cut away to show the track side bottom clearance notch (31) and intermediate step clearance inset (32) which permit the mating of the two panels (10) to form a close fitting joint. The track side top clearance notch (29) and flange side top clearance (30) provide clearance for adding the next layer of panels.

The interior surface (12) may be suitably finished for purposes of corrosion resistance, insulation, sealing and ease of manufacture. Typically a continuous coating covers both the interior (12) and exterior surface as well as the edges of the panel by painting or vinyl coating the entire sheet metal structure.

Figure 6:
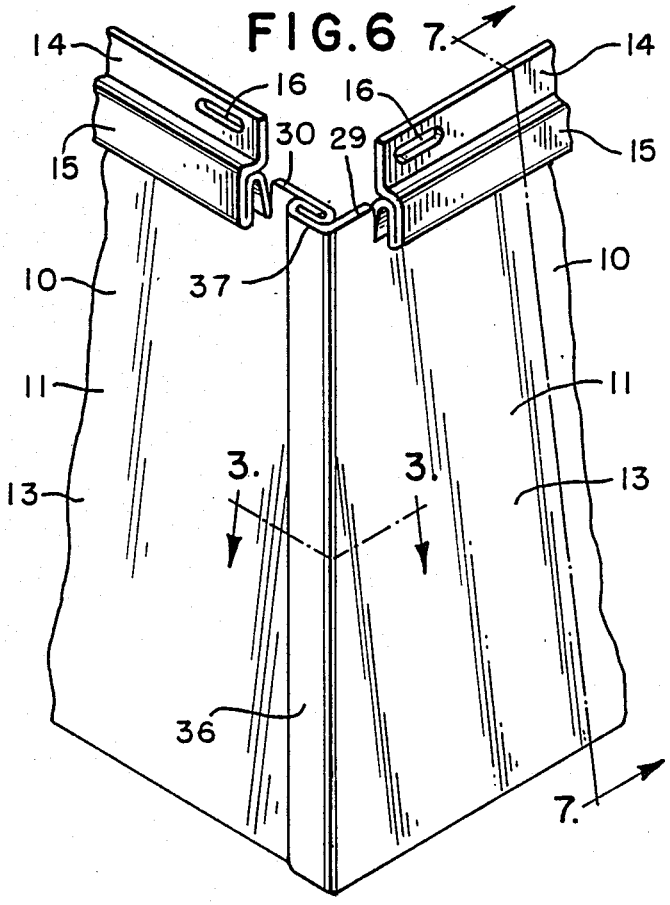
FIG. 6 is a perspective view of a single plane corner structure.

FIG. 6 is a perspective view of the single plane embodiment analogous to FIG. 1. The panels (10) have single planes (11) with outer surfaces (13). The top edge (14) is bent or crimped to form the top flange (15) and has fastener holes (16) the top edges of the corner are relieved (29,30) for clearance of the overlapping layers.

The clearance notch (29) extends through the top of the track (37). The overlapping portion of the track (36) is also apparent in this view.

Figure 7:
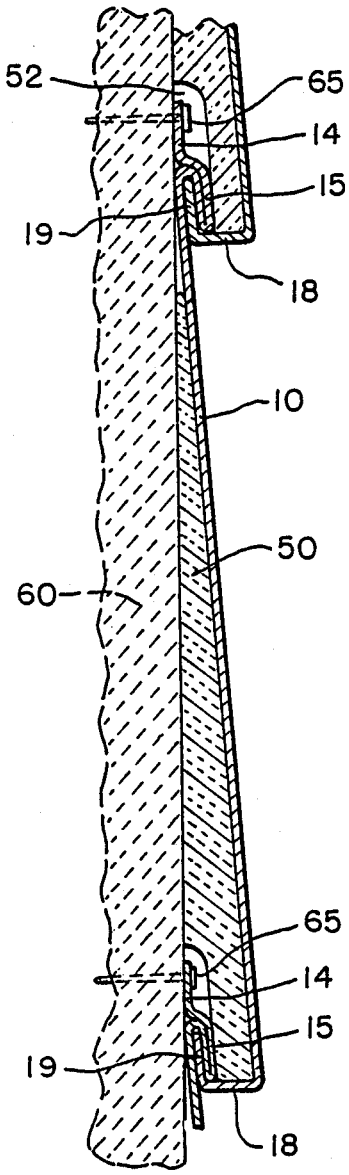
FIG. 7 is a sectional view of a single plane panel and portions of an upper and lower interlocked panel taken substantially on line 3—3 of FIG. 6.

FIG. 7 is a sectional view showing one panel (10) and portions of the panel below and panel above attached to a building (60) with fasteners (65) in the top edges (14) of the respective panels. The immediately higher panel fits over the lower panel with the bottom flange (19) extending upwards from the bottom step (18) engaging the top flange (15).

FIG. 8 is a perspective view showing an alternative embodiment for an interior corner wherein the side flange (26) engages.

FIG. 9 is a sectional view of the interior corner at FIG. 8 in which the flange (29) and the interior corner flange (33) are visible. The insulation (50) provides sufficient clearance between the flange (33) and the wall of the insulation (50) for the engagement of the two flanges.

Figure 10:
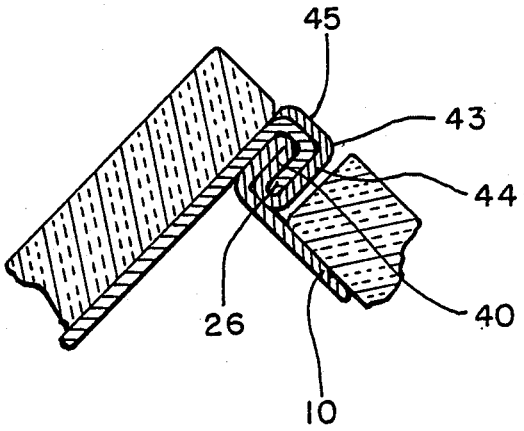
FIG. 10 is an alternative embodiment of an interior corner using a track.

FIG. 10 illustrates an alternative arrangement for an interior corner flange says to form a track (43) operably similar to the exterior corner track in that the underlap (40) remains interior the flange (26) although it is formed by a doubled thickness of material. Since this is an interior corner the function of the previously mentioned overlap is performed by the interior overlap (44) with a locking flange (45) extending substantially perpendicular to the plane of the panel (10) capturing the flange (26) between the edge of the underlap (40) and locking flange (45).

Figure 11:
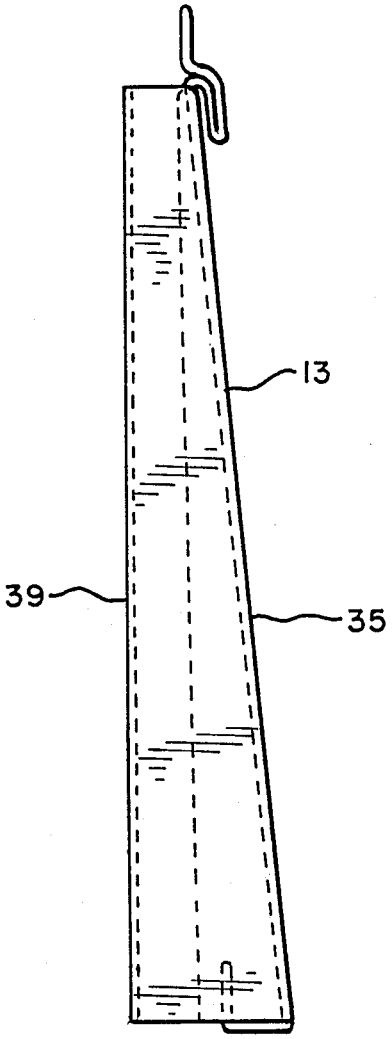
FIG. 11 is an edge view of an alternative embodiment of an exterior corner using a vertical track.

FIG. 11 illustrates an alternative alignment of the track whereby the track end (39) and therefore the track itself is substantially vertical and non-parallel the panel surface (13) and track bend (35) permitting engagement of track and an adjoining flange previously described and sliding vertically in one plane rather than inwardly in two planes as in the previously described embodiment.

FIG. 11 shows bend (35) along a line formed at an angle relative to the bottom edge (17) of the plane (11) substantially equal to the angle of inward topward slope of the plane (11).

The perpendicular siding track in FIG. 11 has an overlap top edge (37) and bottom edge (38) having a relationship such that the parallelogram formed by the bend (35), edge (37) and (38) and the track end bend (39) result in a substantially vertical track end bend (39).

In accordance with my invention I claim:

1. A corner structure for joining siding for a building with walls, comprising a panel with inner and outer surfaces, top and bottom edges, and side edge;

a second panel with inner and outer surfaces, top and bottom edges, and a side edge inverted U-shaped flange aligned adjacent the top edge of each;

the bottom edge of each panel with an inwardly extending step and upturned flange;

one panel being provided with a side edge comprising a U-shaped flange;

the other panel having a side edge with a track;

the track comprising an overlapping portion and an underlapping portion aligned substantially perpendicular to the surfaces of the panel;

the track slidingly engaging the U-shaped flange of a corresponding second panel to form a structurally rigid and weather-tight corner;

2. The invention according to claim 1, and said surfaces inwardly and topwardly inclining and said track on the second panel inclining inwardly to correspond with the inclination of the surface of the second panel.

3. The invention according to claim 1, and said tracks having reentrant portions to provide leakproof weather seals said surfaces being inclined inwardly and topwardly and said track inclining inwardly to correspond with the inclination of the surfaces of the first panel and the corresponding second panel.

4. A corner structure for a building comprising a series of vertically overlapped first and second panels on opposite sides of a corner, the first panels and second panels having overlapping vertical end portions and the end portions of said first panels overlapping the corner.

5. The invention according to claim 4 and said end portions being in the form of interlocking hook-shaped tracks.

6. The invention according to claim 5 and said panels arranged to form an interior corner.

7. The invention according to claim 4 and said end portions being slidable vertically into interlocking engagement.

8. A building corner structure having a plurality of shingle-laid first and second sets of panels positioned at opposite sides of a building, said first and second sets of panels having adjoining edge portions with vertically slidable mating interlocking means.

9. The invention according to claim 8 and the end portion of the first set of panels overlapping the corner.

10. The invention according to claim 9 and said interlocking means being hook-shaped in cross-section.

* * * * *